United States Patent [19]

Skidmore

[11] 4,208,933

[45] Jun. 24, 1980

[54] METHOD AND MACHINE FOR SLICING MATERIALS

[75] Inventor: Lawrence M. Skidmore, Phoenix, Ariz.

[73] Assignee: Armour and Company, Phoenix, Ariz.

[21] Appl. No.: 929,844

[22] Filed: Jul. 31, 1978

Related U.S. Application Data

[63] Continuation of Ser. No. 763,994, Jan. 31, 1977, Pat. No. 4,114,492.

[51] Int. Cl.[2] ..... B26D 7/06; B26D 4/22

[52] U.S. Cl. ..... 83/367

[58] Field of Search ..... 83/364, 367

[56] References Cited

U.S. PATENT DOCUMENTS 3,822,624 7/1974 Shoji et al. ..... 83/364 X

FOREIGN PATENT DOCUMENTS 556769 5/1977 U.S.S.R. ..... 83/367

*Primary Examiner*—Willie G. Abercrombie

*Attorney, Agent, or Firm*—Frank T. Barber; Carl C. Batz

[57] ABSTRACT

Drafts of preselected weight are sliced into a preselected number of slices by passing the material to be sliced through a curtain of radiation to measure the density of the material, and this measurement is used to calculate the length of each draft, which measurement is stored and subsequently read out to control the operation of a stepping hydroelectric motor which pushes the material through a cutting station at the proper speed.

4 Claims, 5 Drawing Figures

METHOD AND MACHINE FOR SLICING MATERIALS

This is a continuation of application Ser. No. 763,994, filed Jan. 31, 1977, now U.S. Pat. No. 4,114,492.

This invention relates to a slicing machine to be used, for example, in the slicing of bacon or the like.

BACKGROUND

Bacon slicing machines of the type commonly used in meat packing operations have a rotatable cutting blade mounted on a motor driven shaft, and slabs of bacon supported on a bed are pushed by a ram in a direction parallel with the shaft into the cutting blade. As the blade rotates, slices fall onto a conveyor which carry them to stations where they are weighed and packaged.

Bacon slabs are notoriously irregular in shape and vary substantially in thickness. They also are irregular in that the fat and lean portions vary in density and are not uniformly distributed throughout the mass of the slab. Because of such irregularities the slicing machines in common use are not capable of forming the sliced bacon into drafts of uniform weight such as ½ lb., 1 lb., or 2 lb., packages which may be desired for packaging and marketing. Moreover, such machines are not capable of making a desired number of slices for each package.

Attempts have been made to regulate the thickness of the slices in accordance with the thickness of the slab. One type of machine operating on this principle employs fingers which sense the thickness of the bacon slab as the slab is advanced toward the cutting blade. U.S. Pat. No. 3,762,257 shows such a machine in which a link mechanism is sensitive to the position of the fingers and operates to control the thickness of the slices. In another type of slicing machine shown in the U.S. Pat. No. 2,954,811, radiant energy is directed through the slab so that some energy is absorbed in the meat while some passes through the meat body. The amounts of radiation which respectively pass through the meat and through a standard absorbent on the other side of the radiation surce, are converted to electric currents and the difference between the amplitudes of these two currents is utilized through amplifying means to operate liquid pumps, the pumped liquid being passed into a hydraulic cylinder the piston of which is moved to drive the meat or other material to be sliced toward the slicing blade.

Attempts as above described have not been successful in commercial practice. One difficulty may be attributed to the high rate of speed at which the slicers normally run. It is common to operate the slicers at speeds which produce 500 to 1000 slices per minute and this is a factor which puts greater demands on machines when a high degree of accuracy is required.

In machines such as disclosed in U.S. Pat. No. 3,762,257 where fingers and mechanical linkages aare relied upon, it is difficult if not impossible to have the movements take place with the speed and precision required, and the necessary precision is not obtained in machines such as in U.S. Pat. No. 2,965,811 where the force which advances the meat to be sliced is the result of operating fluid pumps feeding a cylinder the piston of which moves linearly with the meat. Also, prior attempts to stop the slicing operation when the predetermined weight of each package had been reached resulted in the making of a few very thin slices which were unwanted and have been called "slivers". Perhaps this difficulty may have been atributable to some extent to the high speed of operation of the machine, but the high speeds are necessary in commercial operations.

OBJECTS OF THE INVENTION

It is therefore, an object of the present invention to provide a slicing machine which has devices and mechanisms for the slicing of bacon or the like and which will effectively compensate for irregularities in the shape or density of the material being sliced.

A further object is to prepare from slab bacon or the like a desired number of slices having a prescribed total weight to be contained in each package.

Another object is to obtain such uniform slices assembled for placing in packages of predetermined weight, with the accuracy needed to satisfy the requirement of the market place thus making unnecessary the tedious weighing and "make weight" jobs and avoiding much of the hand labor previously required in such operations.

SUMMARY OF THE INVENTION

Briefly, the above and further objects may be realized in accordance with the present invention by establishing a curtain or beam of radiation between a radiation source and a detector and passing the slab of bacon through the curtain to provide a signal from the detector which varies in relation to the mass of the slab being irradiated. This signal is digitized and integrated as the slab moves through the curtain until the slab portion or draft of predetermined weight has moved through the curtain. The length of the draft is stored and the length of the next draft is immediately determined and stored. This draft length measurement goes on continuously for each slab as the slab moves through the machine so that a number of draft lengths are held in storage as the slab is moved from the sensing station to the slicing station. As each predetermined draft reaches the slicing blade the velocity of slab movement is automatically adjusted to cause the draft to be sliced into a preselected number of slices of uniform thickness. Upon making the last slice in each draft, the slab is momentarily stopped and backed away from the blade a small distance to permit internal stresses in the slab to be relieved without the slicing of slivers as has been common in prior art slicing machines.

Other objects and specific advantages of the invention will become apparent as this specification proceeds.

GENERAL DESCRIPTION OF THE DRAWINGS

One embodiment of the invention is illustrated in the accompanying drawing in which.

Figure 1:
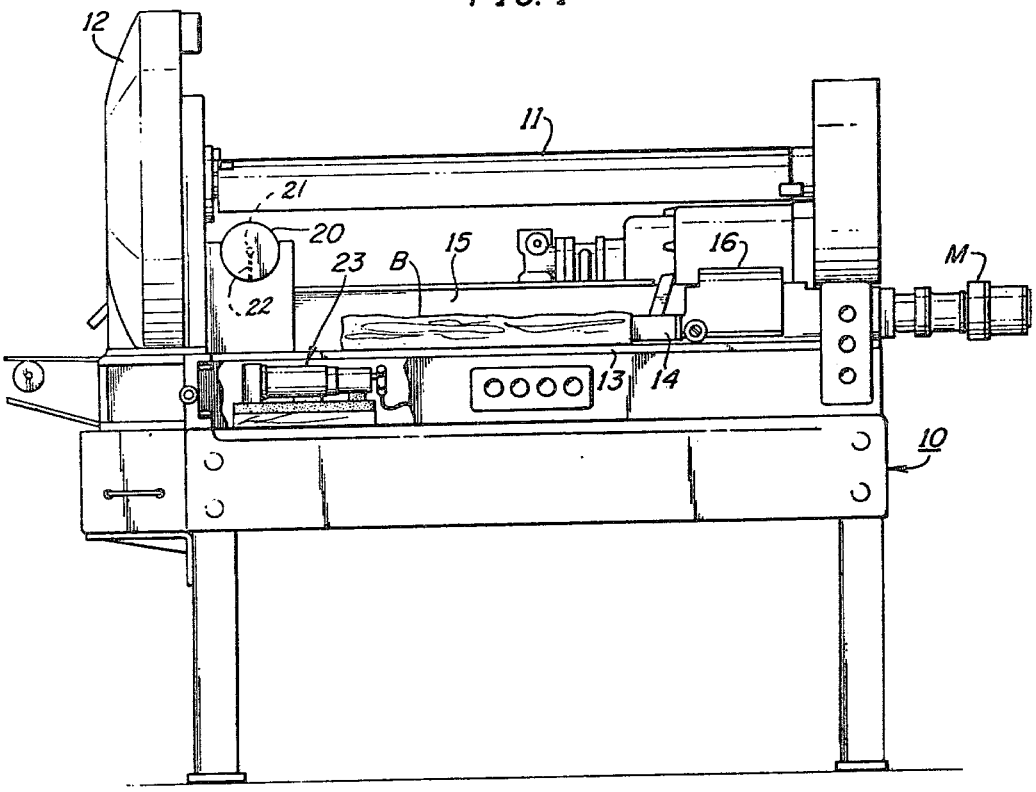
FIG. 1 is a front elevational view of a conventional slicing machine which has been modified to incorporate slicing control equipment embodying the present invention.
Figure 5:
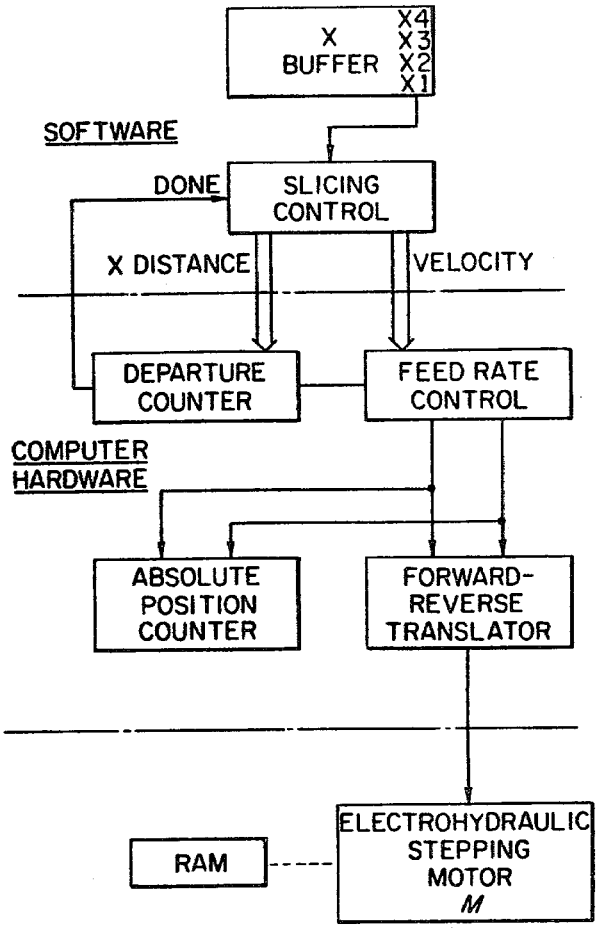

FIG. 5 is a block diagram illustrating the manner in which the length measurements are used to control the operation of the ram. As illustrated in FIG. 1, the slicer has a frame 10, and carried in this frame is a horizontal drive shaft 11 carrying a slicing or cutting blade. The cutting blade is not visible in FIG. 1 but is mounted on one end of the shaft 11 and is protected by a guard 12. A platform or bed 13 is provided for supporting a bacon slab B as the slab is moved forward along this bed toward and through the cutting blade by a ram 14. The ram 14 is mounted just above the bed 13 and is arranged to contact the rear end of the bacon slab B so as to push the slab forward along the bed 13 in a direction parallel to the shaft 11 and toward the cutting blade.

Figure 2:
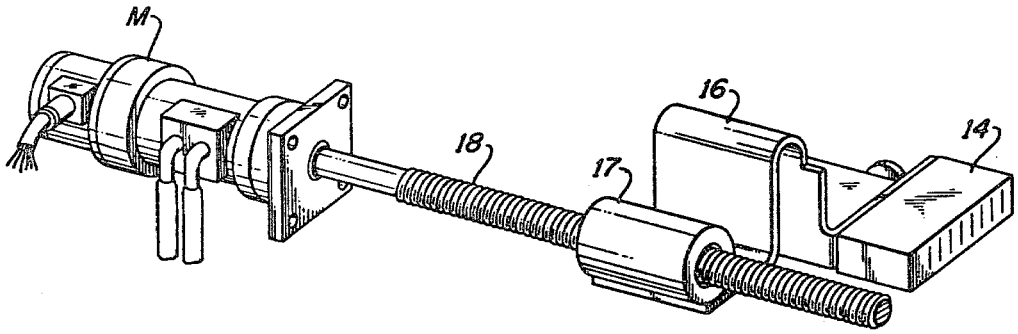
FIG. 2 is a detailed perspective view showing particularly the driving connection between the stepping motor and the ram which pushes the material to be sliced through the slicing station.

At the back side of the bed 13 is a guide rail 15, and a yoke 16 (FIG. 2 disposed over the rail 15 connects the ram 14 with a sleeve 17 at the back side of the rail 15. The sleeve 17 is threaded internally and a drive screw 18 has its threads engaging the threads on the interior of the sleeve 17. The forward end of this screw is rotatably journaled in the frame 10. In accordance with a feature of the present invention the screw 18 is driven from its other end by a stepping motor M. It will be seen that rotation of motor M in one direction rotates screw 18 in one direction, and through the connection of sleeve 17 and yoke 16, drives the ram in one direction, that is forwardly or rearwardly, and that rotation of motor M in the other direction drives the ram in the opposite direction.

The motor M, as illustrated, is a reversible, stepping electro-hydraulic pulse type motor designed to rotate the screw 18 in a plurality of discrete steps. For example, one complete revolution of the screw may be made in 200 steps, wherefor one step of the motor would result (assuming 5 pitch screw threads on the shaft) in a linear movement of the ram 14 of 1 mill. It is, of course, not critical that the motor have 200 steps per revolution, but it may have any other desired number of steps. However, the larger the number of steps the more precise is the control of the movement of the material being sliced and the more uniform is the thickness of the slices. Motor M is a hybrid type motor comprising an electric stepping motor and a hydraulic follower. The stepping motor controls position while the hydraulic section provides torque amplification. As is known in the art, the stepping motor M is driven by a "translator" device which translates step commands to the proper switching sequence of the stepping motor coils.

In order to measure the density of the slab B there is supported in the frame 10 a radiation source mounted within a cylindrical housing 20 having its longitudinal axis parallel with the plane of the cutting blade. Necessarily this radiation source must be located some distance in advance of the cutting blade. In the center of the housing 20 is a pencil-like bar 21 formed of a radioactive material such as cesium$_{137}$ which emits gama rays. This bar of cesium or like material is completely shielded with lead except for a narrow, vertical passage 22 which opens at the bottom of the housing in the shape of a narrow slit. The gamma rays emanating from the bar 21 pass downwardly through the slit to a detector 23 located below the platform 13. When therefore, a slab of bacon is disposed on the platform between the radiation source and the detector, the gamma rays pass through the slab of bacon before reaching the detector. Lead collimators may be provided to absorb sideways radiation and cause all of the radiation from the source to pass through the bacon onto the detector.

As shown, the detector 23 is preferably a scintillation counter and mounted in the frame 10 below the bed 13 in alignment with the radiation source. This detector may be formed of polyscin material the function of which is to detect gamma radiation not absorbed by the bacon. The crystals of such material emit light pulses corresponding in number to the gamma rays which they detect and the light so emitted is converted to electrical impulses amplified by a plurality of photomultipliers which are optically coupled to the detectors 23. The resulting electrical signal, in the form of voltage pulses, is discriminated on the basis of energy level by a system of amplifiers, and is fed to the interface of the computer. This signal represents quantitatively the radiant energy which has passed through the bacon in a plane transverse to the direction the bacon is moving toward the slicing blade.

Figure 4:
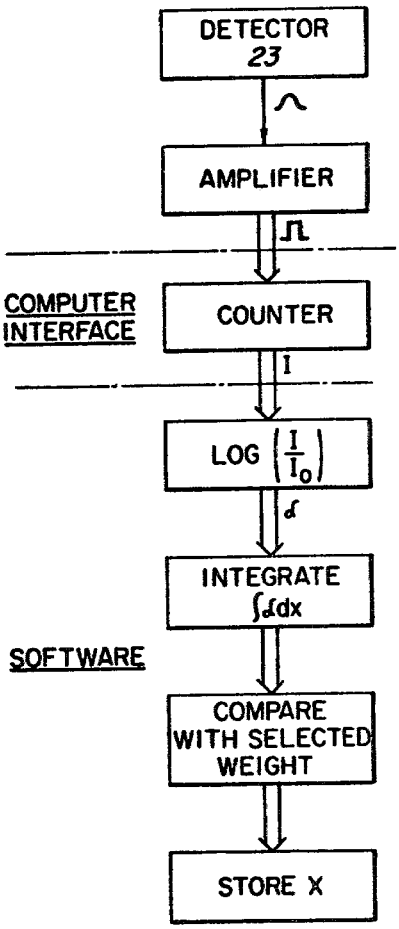
FIG. 4 is a block diagram showing the manner in which the detected density signal is converted to length measurements.

The computer functions are diagramtically illustrated in FIGS. 4 and 5. The computer performs two basic functions, the first of which is to determine the length of each draft of bacon which is to go into each package and so prepare the data needed to control the slicing; and the second of which is to control the slicing operation by giving the commands needed to carry out the actual slicing of the meat. The two basic functions are substantially independent but ordinarily occur simultaneously because as one portion of the slab is being sensed another portion is being sliced in accordance with the information previously sensed and stored.

The manner in which the first of these functions is carried out is illustrated in FIG. 4. The light signal from the photomultipliers is converted to an electrical signal, and the pulses are counted at the interface of the computer. As there shown, output pulses of at least a predetermined amplitude from the detector are amplified and shaped to provide digital pulses of uniform width and amplitude. These digital pulses are counted to determine the length of each draft of preselected weight to be sliced.

The density of the bacon may be calculated from the measured data indicating the proportion of the total radiation which it absorbs. This calculation is made in accordance with the following relationship:

$$\delta = K \text{ Log } (I/I_o)$$

where $\delta$ is density

K is the absorption coefficient $I_o$ is the measured pulse count when no bacon is obstructing the beam (this factor may be determined before the bacon is started through the machine and I is the measured pulse count with the bacon or other product in the beam of the radiation. (This factor is represented by the signal presented to the computer.)

The density may be converted to weight by integrating the density value with respect to length when length is measured along the length of the bacon slab. Since the weight of the package desired is predetermined and may be ½ lb., 1 lb., or some other selected weight, through the above relationship the length ofthe material to be sliced for each package of the preselected weight is determined.

The density of the material being sliced is integrated as it passes through the gamma beam to measure weight. This is a numerical integration or summation of density values multiplied by the differential changes in position. The integration is independent of the velocity of the meat during slicing.

Figure 3:
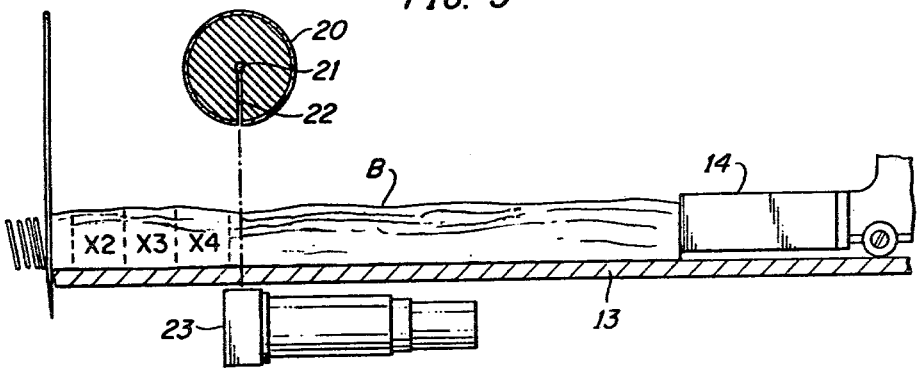
FIG. 3 is an elevational view, partially schematic, illustrating the manner in which the slab of bacon is pushed through the slicer.

As indicated in FIG. 4, the signal received by the computer is converted to the value log $(I/I_o)$ and this value is integrated according to $\delta dx$ where $\delta$ is density and dx is a small incremental movement of the ram, until this value reaches the predetermined desired package weight at which time the determination is concluded, and the resulting length measurement referred to herein as x, is passed to storage in the memory section of the computer. Inasmuch as the radiation source and detector are located a substantial distance ahead of the slicing blade, several drafts of the preselected weight will ordinarily be located between the sensing and slicing stations. These measured drafts are illustrated in FIG. 3 as X2, X3, and X4, with X1 being in the slicing station. Accordingly, signals X1, X2—XN, corresponding respectively to the lengths of several drafts are stored at any given time for subsequent use in controlling the rate at which the ram pushes the slab through the slicing blade.

The second basic function of the computer, i.e. controlling the movement of the ram to provide the number of slices of equal width in each draft, is illustrated by the block diagram shown in FIG. 5. The buffer includes the value X representing the length of the particular slab being sliced as well as the values X2–XN.

Since the plane at which the density value of each measured increment of the slab is in advance of the actual slicing position, the data for executing the slicing operation are held in storage in the computer until the initial plane of each slab actually reaches the cutting blade. The length X is divided by the desired number of slices and the ram speed or feed rate is set accordingly. Throughout the slicing of each draft the feed rate is continuously updated by means of the departure counter and the instantaneous rate is based on the distance to go and the time available, the time available being calculated from the time per rotation of the slicer and the number of slices remaining. This operation stops itself when the last slice feed rate has been calculated.

As each increment of distance of slab travel is utilized, there is a conversion to a corresponding actuation of Motor M to cause the armature of this motor to move angularly a corresponding number of steps so that the predetermined number of slices will be produced totaling the predetermined weight for the package.

When the slicing operation has proceeded to the point where the predetermined weight of the package is reached, the computer gives the command terminating further movement of motor M and the ram 14. It might be presumed that upon stoppage of the motor no more bits would be taken by the cutting blade, but tests indicate that this is not the case. In practice, it was found that a few slivers of meat were made after the run had actually stopped and these slivers not only spoiled the appearance of the packages, but also altered the weights of the packages.

We discovered that this tendency to produce slivers could be avoided by programming the computer so that instead of merely stopping the movement of the motor and the ram when the last slice has been cut, the motor is reversed in direction for a few steps of the motor. The forward-reverse translator is thus used to control the motor M. It now appears that the reason why the slivers are sliced in the prior art slicers is that the forward movement of the ram places the meat under compression, and after the forward movement of the ram has been stopped, the meat tends to slowly expand. We have found that if the movement of the ram in a forward direction is not only stopped but reversed in direction the production of the slivers is avoided.

In connection with the computer function which reverses the ram and brings the slab back slightly at the end of the package slicing operation, it is necessary to interrupt the density measurements during this momentary reversal of slab movement and to again commence such measurements only after the ram has again moved forward to its prior forward position. Accordingly, operation of the counter in the circuit of FIG. 4 is gated off during this forward and reverse motion of the ram at the end of each draft.

OPERATION

In beginning the operation of the machine to slice a slab of bacon it is assumed that the weight of each package and the number of desired slices per package will have been decided upon or determined in advance.

The operator may face the machine as it is seen in FIG. 1 and place the bacon slab to be sliced on the bed 13 of the machine in front of the ram 14. First, the usable bacon at the front of the slab may be removed by starting and stopping the slicer by hand or this unusable portion may be removed automatically be running the data collecting functions from a time the detected radiation falls below a certain level indicating that the front tip of the slab has reached the beam. Then the slab may be moved forward to bring its tip to the position of the blade and integration continued from this point until a prescribed length is reached to remove what is called the "front heel discard". Completion of this back-up function may trigger the beginning of integration to obtain data for the regular packages of sliced bacon to be made. The storing of data for the first package begins after a period of time. When the trimmed front end of the slab reaches the cutting blade, the actual controlled slicing begins and is carried out according to the instructions received from the computer memory or X storage for the first package.

When the first package has been sliced, the computer causes reversal of the motor direction and a slight back-up of the ram. In the meantime, the data X2 for the second package will have been received in the computer memory. This operation continues with the one basic function, obtaining and storing data for the slicing of a package, and the other basic function causing the execution of the slicing in accordance with the record made by the one basic function, until the slab is completely sliced.

The slices of bacon so made are dropped onto a conveyor which receives them from the cutting blade in the form of drafts of bacon which are transported on to further packaging operations. Each of the drafts are of preselected weight and the slices in each draft are of uniform thickness. Further, the computer may be programmed so that when the end of the bacon slab is reached the motor is reversed so that it automatically reverses the motor M to run the ram back to its farthest retracted position. At this time the background intensity $(I_o)$ is measured and stored for use in calculating the draft lengths in the next slab to be sliced.

It is an important feature of our slicing system that the weight of each draft or package is measured by integrating the density of the slab along the length of the slab; and it is another feature that the record of each slab length is made at some position in advance of the cutting blade, and that this record is utilized to control the slicing at a later time when this previously sensed portion of the slab has reached the cutting blade.

It is yet another feature that the motor power for advancing the bacon is a stepping motor, particularly an electrohydraulic pulse motor, and that the power from such motor is delivered to the ram through a rotating screw, thereby to provide both precise and instantaneous control of ram speed and position.

Still another feature is the provision for back-up motion of the ram avoiding the production of slivers at the end of each draft or package.

In the foregoing description only one embodiment of the machine or system has been set forth and this has been explained particularly in connection with the slicing of bacon slabs, but it should be understood that the invention may be contained in any number of embodiments and that other materials such as cheese and sausage, as well as materials other than food may also be sliced using the invention.

It will also be apparent to those skilled in the art that many variations and changes may be made in the invention as herein described and all such variations and changes may be considered as within the spirit of the invention and the scope of the appended claims.

I claim:

1. A method of slicing a plurality of drafts of a resilient material by moving said material through a slicing station comprising the steps of exerting a compressive force on said material to move said material through said station, relieving said force after each of said drafts have been sliced to prevent the slicing of slivers between said drafts.

2. A method as set forth in claim 1, in which said force is relieved by reversing the direction in which said material is moved through said station

3. A method as set forth in claim 1, in which said material is moved through said station by a ram driven by a motor and in which said force is relieved by reversing the direction of said motor.

4. A method as set forth in claim 3, in which said motor is a stepping motor and said force is relieved by driving said motor at least one step in a direction opposite the direction it was driven to move said material through said station.

* * * * *